US006196429B1

(12) United States Patent
Cavdek et al.

(10) Patent No.: US 6,196,429 B1
(45) Date of Patent: Mar. 6, 2001

(54) DRESS OR CLOTHING FORM

(75) Inventors: Richard S. Cavdek, Glendale; Darren Saravis, Long Beach; John Duval, Signal Hill; David Potter, Signal Hill; Brian Heidsek, Signal Hill, all of CA (US)

(73) Assignee: Cyberform Corp., Glendale, CA (US)

( * ) Notice: Subject to any disclaimer, the term of this patent is extended or adjusted under 35 U.S.C. 154(b) by 0 days.

(21) Appl. No.: 09/301,441

(22) Filed: Apr. 28, 1999

Related U.S. Application Data

(60) Provisional application No. 60/083,494, filed on Apr. 29, 1999.

(51) Int. Cl.[7] ..... D06C 15/00

(52) U.S. Cl. ..... 223/68; 223/66; 223/120

(58) Field of Search ..... 223/66, 68, 74, 223/77, 120; 434/396

(56) References Cited

U.S. PATENT DOCUMENTS

| | | | | |
|---|---|---|---|---|
| 722,983 | * | 3/1903 | Hoffman | 223/66 |
| 2,367,171 | * | 1/1945 | Kroll | 223/66 |
| 3,033,429 | * | 5/1962 | Richterkessing | 223/68 |
| 3,511,423 | * | 5/1970 | Artur et al. | 223/66 |
| 3,734,362 | * | 5/1973 | Arthur | 223/66 |
| 4,792,071 | * | 12/1988 | Scarpa et al. | 223/66 |
| 5,265,779 | * | 11/1993 | Jiang | 223/66 |

* cited by examiner

*Primary Examiner*—Bibhu Mohanty
(74) *Attorney, Agent, or Firm*—John E. Wagner; Robert C. Smith; Sam Bernardo

(57) ABSTRACT

A dress or clothing form includes a sheet metal back to which are attached a plurality of reinforcing strips. A support rod is carried on one of the reinforcing strips and on the back. Leg supports are attached to the back to which are attached a pair of flat leg panels. Front and back molded plastic body panels are secured by fasteners to the metal back and similar molded front and back leg panels are secured to the flat leg panels. The support rod includes a large diameter portion at its top which includes a tapered surface. This surface mates with a socket on a support arm attached to a stand for supporting the form at the desired height. The stand includes telescoping members each including a rack with one member including a gas spring connected to a pinion positioned between the racks. The gas spring is arranged to essentially balance the weight of the dress form and garment so that a worker can move it up and down with little effort. A pedestal supports the stand and includes a latch means for preventing telescoping of the stand while it is being moved.

8 Claims, 8 Drawing Sheets

15
10
14
38
50
40
53
62
48
64
39
51
13
12
49
49
46
20
39
60
18
24
26
52
16
32
28
30
54
36
34
56
58

DRESS OR CLOTHING FORM

REFERENCE TO RELATED APPLICATIONS

This is a non-provisional patent application based upon provisional application Serial No. 60/083,494, filed Apr. 29, 1999 the benefit of which is claimed.

FIELD OF THE INVENTION

This application relates to dress or clothing forms and a stand for supporting such forms.

BACKGROUND OF THE INVENTION

As the fashion industry becomes increasingly multinational, differences in what were thought to be somewhat standardized sizes and proportions of women's dresses have become both more apparent and more troublesome. Thus, a size 8 in New York may not have a corresponding counterpart in garments shipped from Europe or Asia. There is, therefore, a need for a way to produce a standardized size such that when a buyer in New York, for example, wishes to order garments of a particular size from Asia, there will be a way to be certain that the size is consistent with what is desired.

BRIEF DESCRIPTION OF THE INVENTION

Applicants have provided a dress form and a method of producing dress forms in any quantity desired and which are very uniform in size and configuration. Such forms can then be shipped anywhere in the world to provide reasonable assurance that a plurality of size 8 dresses of a certain style ordered from Taiwan will be the same size and configuration as those initially designed in New York.

The process begins with a large number of measurements from human models. There are usually measurements from more than one size 8 model, for example, and these measurements are then averaged out to provide a standardized set of measurements. These measurements are then put in digital from and entered into a computer (UNIX WORKSTATION) to create a substantial number of three-dimensional cross sections. These cross sections are then used to create a computerized three dimensional NURB surface (non-uniform rational B spline) which is a close approximation of what is desired and the surface of which can be manipulated to specifications provided by the client. This surface configuration is then put in form for computer aided design (CAD)—parametric solid modeling. The CAD data is then converted to computer aided machining data which is supplied to a numerically controlled machine to produce tooling for producing vacuum formed body panels. The body panels are then trimmed with padding and muslin and mounted on a dress form chassis. Limited changes in dimensions are taken up with padding of the body panels.

Applicants have also provided a novel dress form chassis and stand which are convenient for working with the dress form and changing its position.

BRIEF DESCRIPTION OF THE DRAWING(S)

This invention may be more clearly understood with the following detailed description and by reference to the drawings in which:

FIG. 4 is an exploded view of the dress form and chassis of FIGS. 1, 2 and 3;

FIG. 4A is a perspective view, on an enlarged scale of the telescoping shoulder members of FIG. 4;

DETAILED DESCRIPTION OF THE INVENTION

Figure 1:
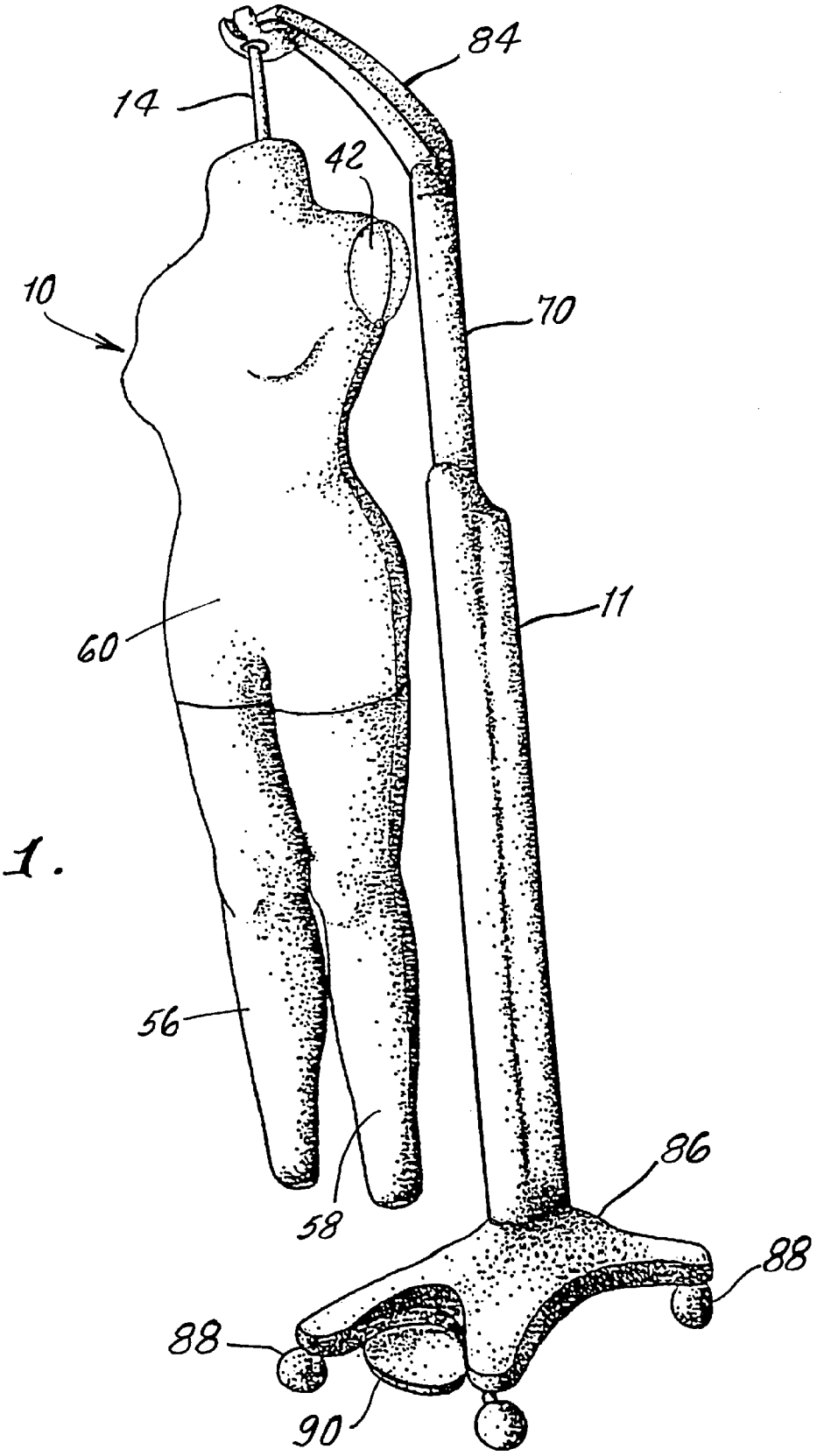
FIG. 1 is a perspective view of a dress form and stand according to the present invention.

FIG. 1 is a perspective view of the dress form chassis 10 and stand 11 according to the invention. The dress form itself is formed of a plurality of plastic panels whose dimensions and contours are determined by parametric solid modeling as described above. The plastic panels are then covered with padding and muslin. Supporting the panels is a chassis, described below, which includes a rod 14 which terminates in a larger diameter knob having a tapered surface 15 joining the main shaft with the larger diameter portion. Stand 11 includes a main support rod 70 carrying a laterally extending arm 84 which includes a socket which receives the tapered surface 15 of rod 14. The stand 11 is mounted on a pedestal 86 to which are attached a plurality of casters 88. A foot pedal 90 carried on pedestal 86 provides a means for adjusting the position of the dress form chassis 10 as discussed below.

Figure 2:
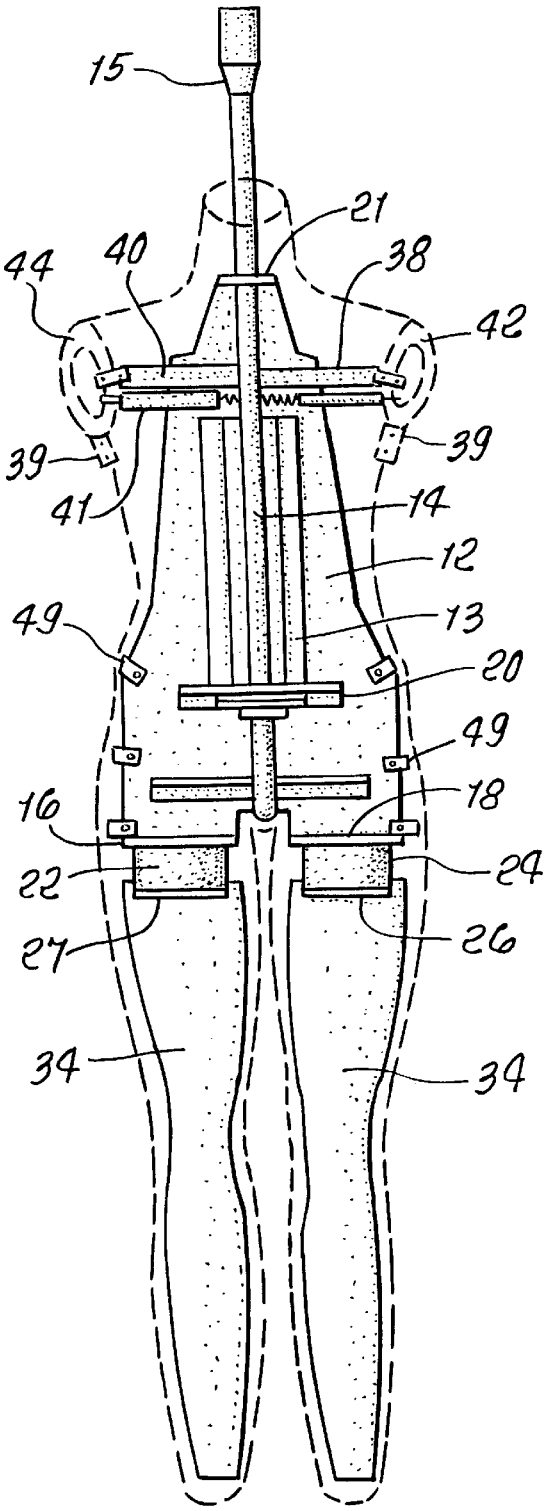
FIG. 2 is a front elevational view of a dress form chassis according to the invention.
Figure 3:
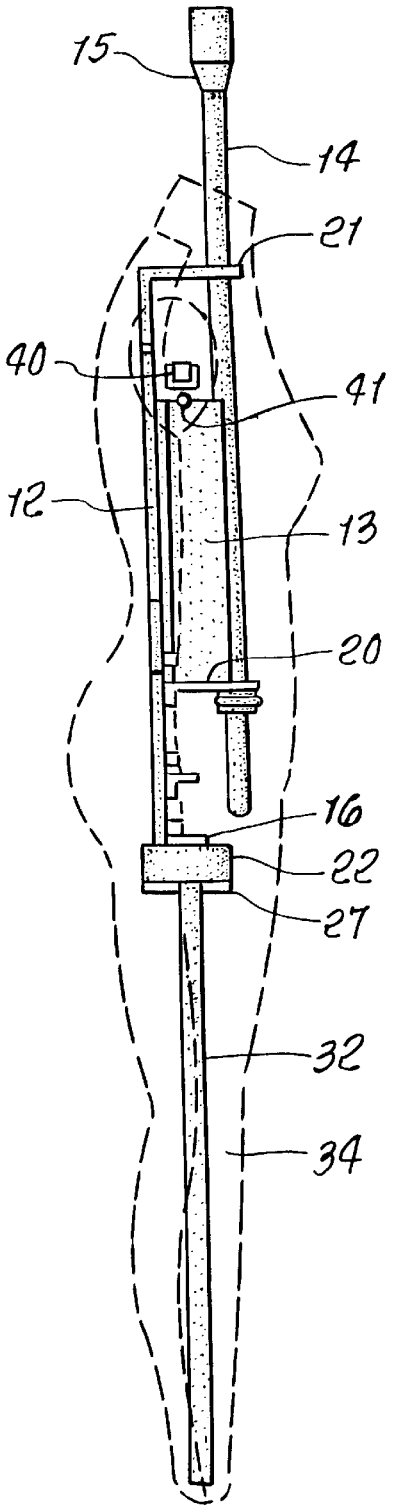
FIG. 3 is a side elevational view of the dress form chassis of FIG. 2.

FIG. 2 is a front elevational view of the dress form chassis with the dress form itself shown in phantom and FIG. 3 is a side elevational view thereof.

Referring to FIGS. 2 and 3, the dress form chassis includes a heavy sheet metal back 12 to which is attached a vertical stiffening support 13 and a rod 14 which extends from the top of the dress form as assembled. Rod 14 includes an expanded portion at the top including a tapered surface 15 which cooperates with the associated stand to secure the dress form to the stand as discussed below. Also attached to back 12 are support members 16, 18 and 20 which may be simple angle members. Members 16 and 18 are attached to cylindrical members 22 and 24. Member 20 supports the lower end of rod 14 which is secured at its upper end by a flange 21 which is part of back 12. Shown attached to member 24 is a circular leg top member 26. A similar circular top member 27 is attached to member 22. Members 26 and 27 have openings to receive vertical rods 32 (FIG. 3) which attach to flat leg forms 34 and 36 extending for essentially the length of the dress form leg. The support structure for both flat leg forms 34 and 36 are identical.

Secured near the top of back 12 are a pair of horizontal telescoping shoulder members 38, 40 which include a latch (not shown) permitting shoulder members 38, 40 to expand or contract laterally to aid in putting on and removing garments. A pair of shoulder support pads 42, 44 are attached at the ends of shoulder members 38, 40, respectively. An additional spring loaded telescoping tube 41 cooperates with member 38, 40 to permit pads 42, 44 which are hinged to the dress form chassis 10 by means of hinges 39, to move in or out to fit or remove garments. This structure is discussed in detail below. Attached to the dress form chassis 10 are several of the vacuum formed body panels referred to above. These may be secured by staples or any convenient means to any of several attachment tabs 49.

FIG. 3 is a left side view of the chassis 10 showing the relationships of the parts described above. Rod 14 passes through support 20 and is carried thereby. The upper part of rod 14 is supported in a flange 21 which is part of back 12.

FIG. 4 is an exploded view of the dress form and chassis described above. In this view it will be apparent that support 13 has substantial thickness perpendicular to the plane of back 12 for stiffening. Support members 16, 18 and 20 are shown with member 20 in position to support the lower end of rod 14. Attached to members 16 and 18 are cylindrical members 22 and 24. Circular top leg member 26 is shown along with other circular leg top member 26 and member 28 through which vertical rod 32 passes which supports flat leg form 34.

Also shown are the telescoping shoulder members 38, 40 which are attached by links 38A and 40A to shoulder support pads 42 and 44. A cylindrical telescoping tube 41 including telescoping tubes and an internal spring 41A urge shoulder support pads 42 and 44 outwardly when the latch on members 38 and 40 is released. Shoulder support pads 42, 44 are manually pushed inwardly against internal spring 41A to aid in removing garments from the dress form chassis 10. Small dowels 41B extend from shoulder support pads 42 and 44 and fit loosely into the ends of cylindrical telescoping tube 41 to assure alignment of tube 41 when shoulder support pads 42, 44 are moved in and out since they are hinged at their attachment points on the molded body parts and move in an arcuate manner.

The dress form itself is composed of a plurality of vacuum formed body panels whose dimensions and contours are established as described above. These may be secured by staples or any convenient means to any of several attachment tabs 49. Shown are a rear body torso panel 50, a rear right leg panel 52, a rear left leg panel 54, a front right leg panel 56, a front left leg panel 58 and a front torso panel 60.

FIG. 4A is a perspective view, on an enlarged scale, of the telescoping shoulder members 38 and 40 and tube 41 in association with a shoulder support pad 42. Members 38 and 40 incorporate a latch mechanism which holds ends which releases the latch. Members 38 and 40 will then extend outwardly under the force of them in a particular position until one pushes on the spring 41A in cylindrical telescoping tube 41 until the latch catches in another position. This causes shoulder support pad 42 (as well as shoulder support pad 44) to swing outwardly on its hinge 39. Member 38 is pivotally attached to block 55 by means of a link 38A which is secured to shoulder support pad 42. Cylindrical telescoping tube 41 receives a dowel 41B which is secured to block 55. Since shoulder support pads 42 and 44 are hinged, there must be some "play" in the connections with members 38 and 40 and tube 41 to permit the shoulder support pads 42, 44 to have the desired arcuate movement. The connections with shoulder support pad 44 are the same.

Figure 5:
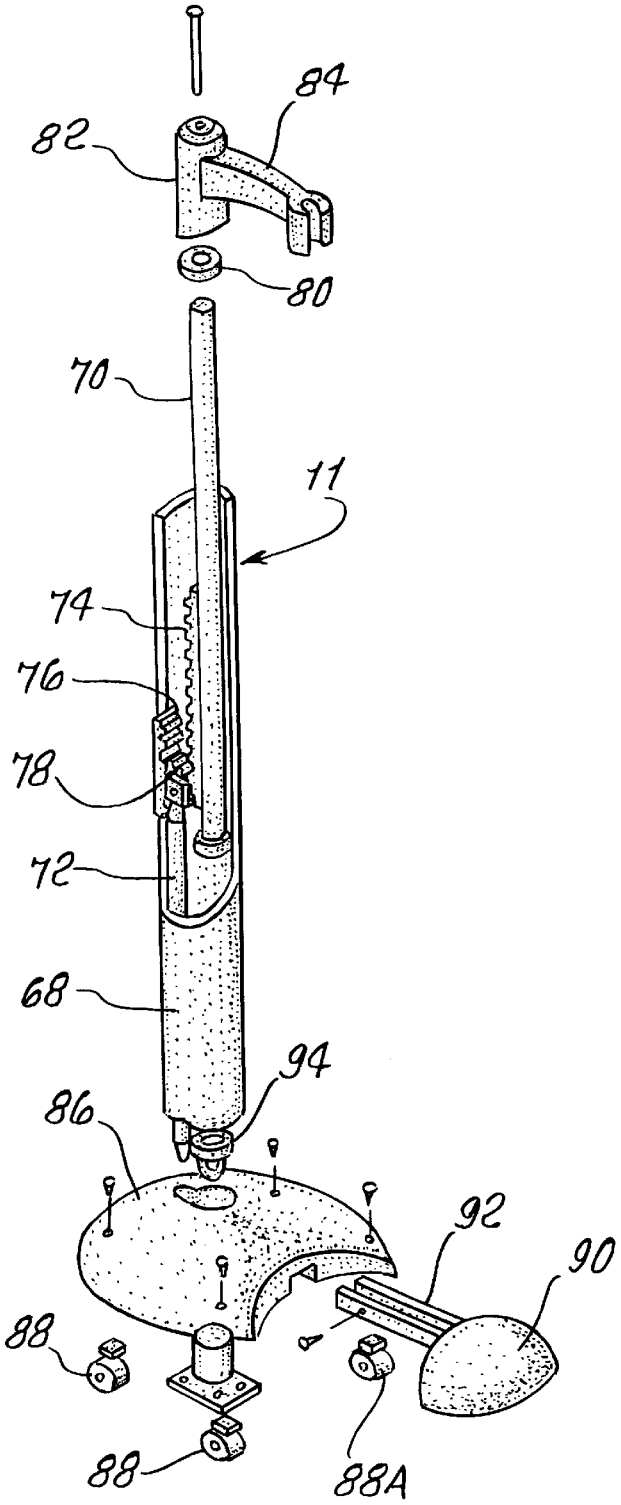
FIG. 5 is an exploded view of the dress form stand used in combination with the dress form chassis of FIGS. 2, 3 and 4.

FIG. 5 is an exploded view, partly broken away, of the stand 11 used to support the dress form. This stand has a number of useful features, one of the most important of which is that it enables one seated adjacent to the form to move the dress form and garments up and down over a very useful range of about 24 inches without having to exert more than a very minimum force. It also includes a means for locking the moving parts in position when the dress form is not in use or for moving the stand and dress form. A further feature is that a device responsive to tipping of the stand automatically locks the moving parts in position.

Located within a gas strut housing 68 are a rod 70 and a gas spring or strut 72. Rod 70 carries a rack 74 and a similar rack 76 is secured to an inside wall of gas strut housing 68. Positioned between racks 74 and 76 is a pinion 78 which is secured to the top of the gas spring housing. A glide 80 is positioned in the top of housing 68 and serves as a guide for rod 70. Attached to the top of rod 70 is a sleeve 82 carrying arm 84 which supports the dress form and chassis.

The gas spring or strut 72 is a commercially available device including an exterior housing containing a piston and a rod 73 attached to the piston. Energy is contained in the housing in the form of gas under pressure. As stated above, the gas strut housing 68 is fastened to pinion 78. The rod 73 is secured to the housing and is normally locked in a collapsed or contained position within the housing by means of an internal latch until released.

The housing 68 is asymmetrically mounted on a pedestal 86 to which are attached a plurality (normally four) of casters 88. One caster 88A includes a brake as is well known in the art. Also attached to pedestal 86 is a pedal 90 attached to an elongated brake lever 92 which extends under the surface of the pedestal where it makes contact with a button on the end of the rod 73 of gas spring or strut 72 to release its lock or latch. Once this latch is released, the energy in the gas spring effectively counterbalances the weight of the dress form and chassis suspended from the stand and the dress form and chassis may be easily moved up and down. As will be understood, the arrangement with racks 74 and 76 and pinion 78 provides a 2 to 1 mechanical advantage whereby rod 70, sleeve 82, arm 84 and dress form and chassis 10 move up or down twice as far as gas spring or strut 72 and pinion 78 are moved.

Figure 5A:
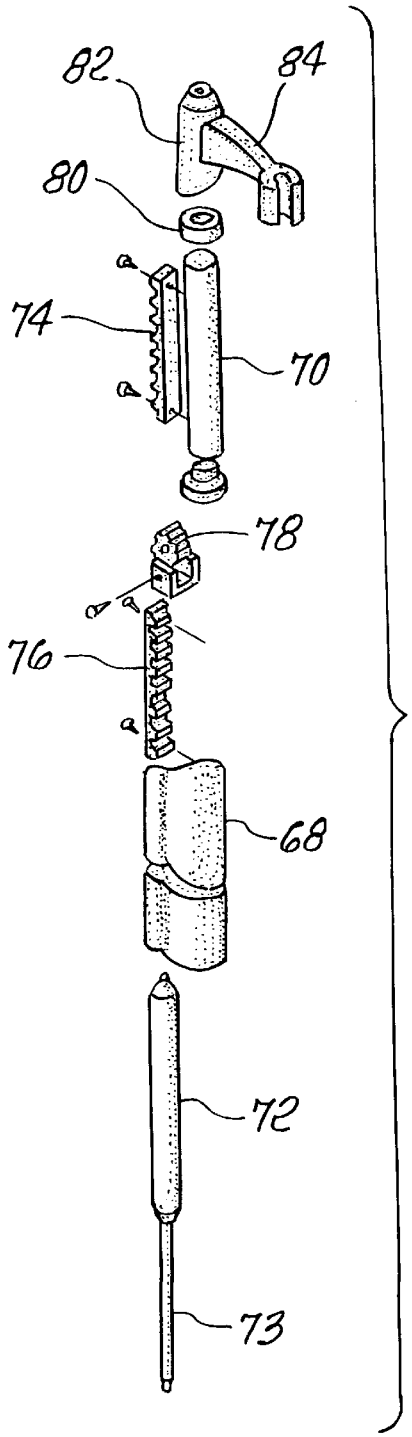
FIG. 5A is a further exploded view of the parts of FIG. 5.

FIG. 5A is an exploded view of the movable parts of FIG. 5 with the housing 68 much shortened to show the relationships of the inside parts. Rod 70 and rack 74 are fastened to sleeve 82 and arm 84 from which the dress form and chassis are suspended. Rack 76 is secured to housing 68 and pinion 78 is fastened to the housing of the gas spring or strut 72. The rod 73 of gas spring or strut 72 is secured at the lower end of housing 68 so that as gas spring or strut 72 expands, moving its housing and pinion 78 up rack 76, rack 74 is moved upwardly twice as far as pinion 78, also carrying rod 70 twice as far as gas spring or strut 72 moved.

Also secured in the lower end of housing 68 such that it is interposed between the end of lever 92 and the gas spring rod 73 is a safety interlock device 94 (FIG. 5). This device includes an inverted conical surface with a ball bearing normally seated at its apex. When pedal 90 is touched, the lever 92 moves device 94 slightly upwardly causing the ball to contact rod 73 and releasing the latch on gas spring or strut 72. Should the stand tend to tip over as might happen during moving it, the ball in device 94 will roll up the side of the inverted cone, in which position the gas spring or strut 72 is locked and no movement or accidental contact with pedal 90 will contact rod 73 to release the latch in gas spring or strut 72. This is shown in greater detail in connection with FIG. 9.

Figure 6:
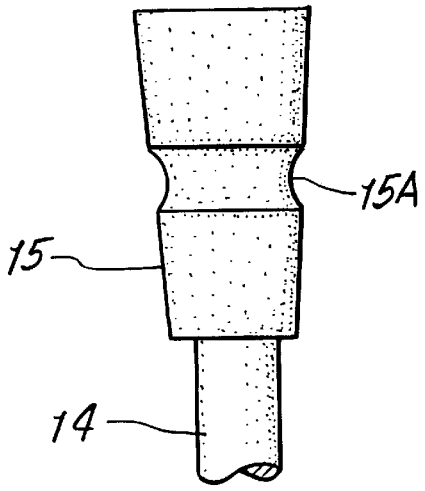
FIG. 6 is a side elevational view of the attachment fixture for attaching the dress form chassis to the stand.
Figure 7:
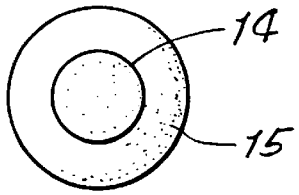
FIG. 7 is a top view of the fixture of FIG. 6.
Figure 8:
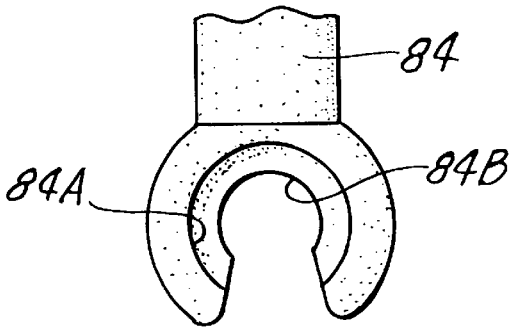
FIG. 8 is a top view of the socket end of the support arm used in the stand of FIG. 5.
Figure 9A:
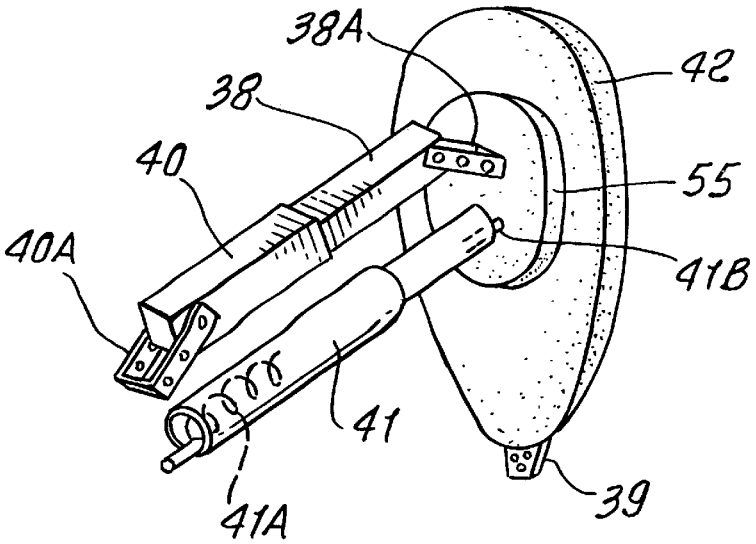
Figure 9:
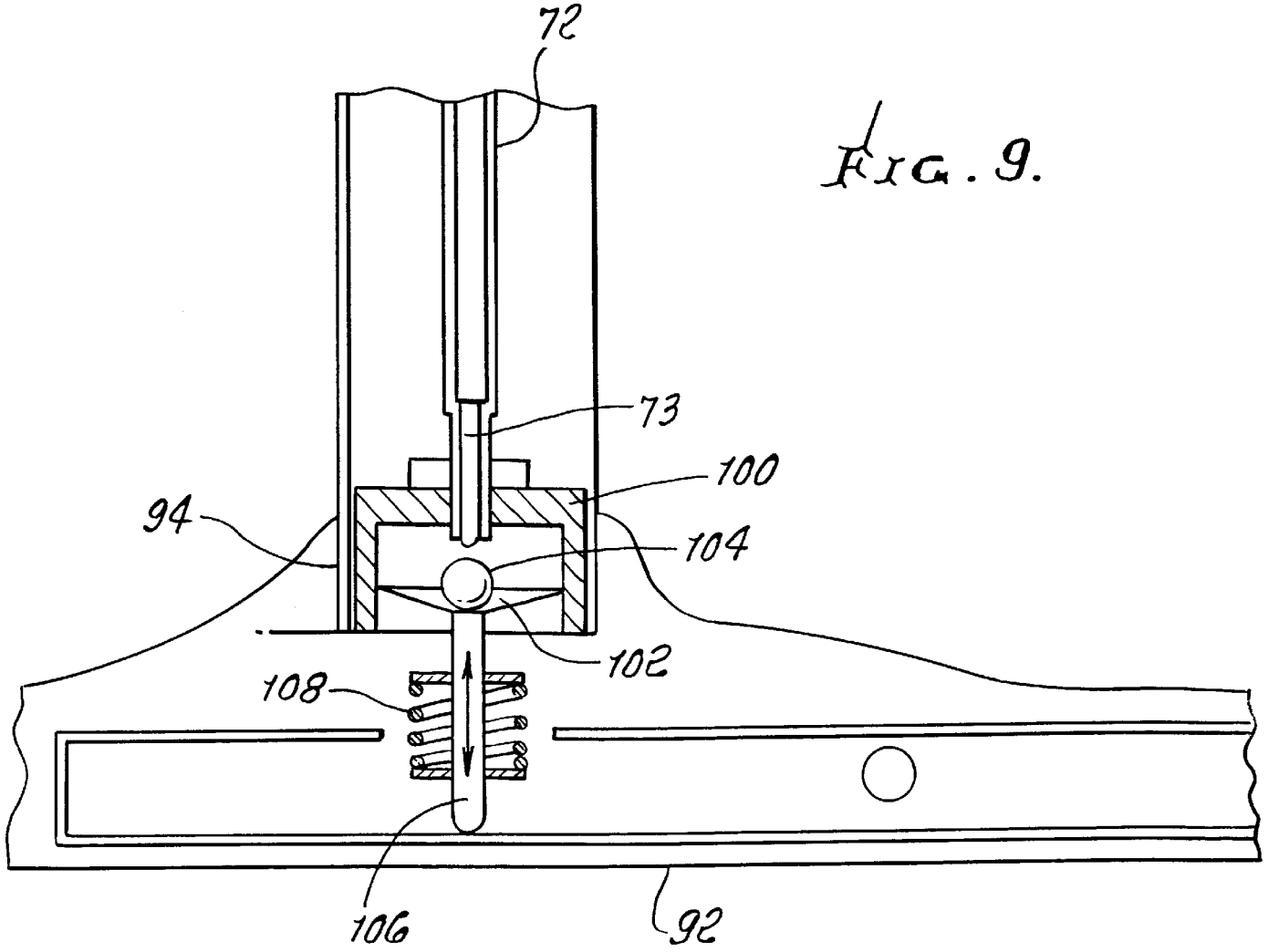

Because of the need to remove the dress form and chassis from the stand with some frequency, it is desirable that the connection between the attachment end of arm 84 and the tapered surface 15 of rod 14 be firm to avoid unnecessary movement while the dress form is being worked on, but also capable of convenient and easy release. FIGS. 6 and 7 are, respectively, a side elevational view looking at the tapered surface 15 of rod 14 and a top view of the enlarged part of rod 14. FIG. 8 is an enlarged top view of the end of arm 84 which receives tapered surface 15. It will be observed that the top inside edge 84A has a significantly larger diameter than the bottom edge 84B showing the taper that matches that of tapered surface 15. These parts are held together securely by the weight of the dress form and chassis. The detent 15A receives a ball (not shown) which further latches tapered surface 15 and arm 84 together.

Figure 9:
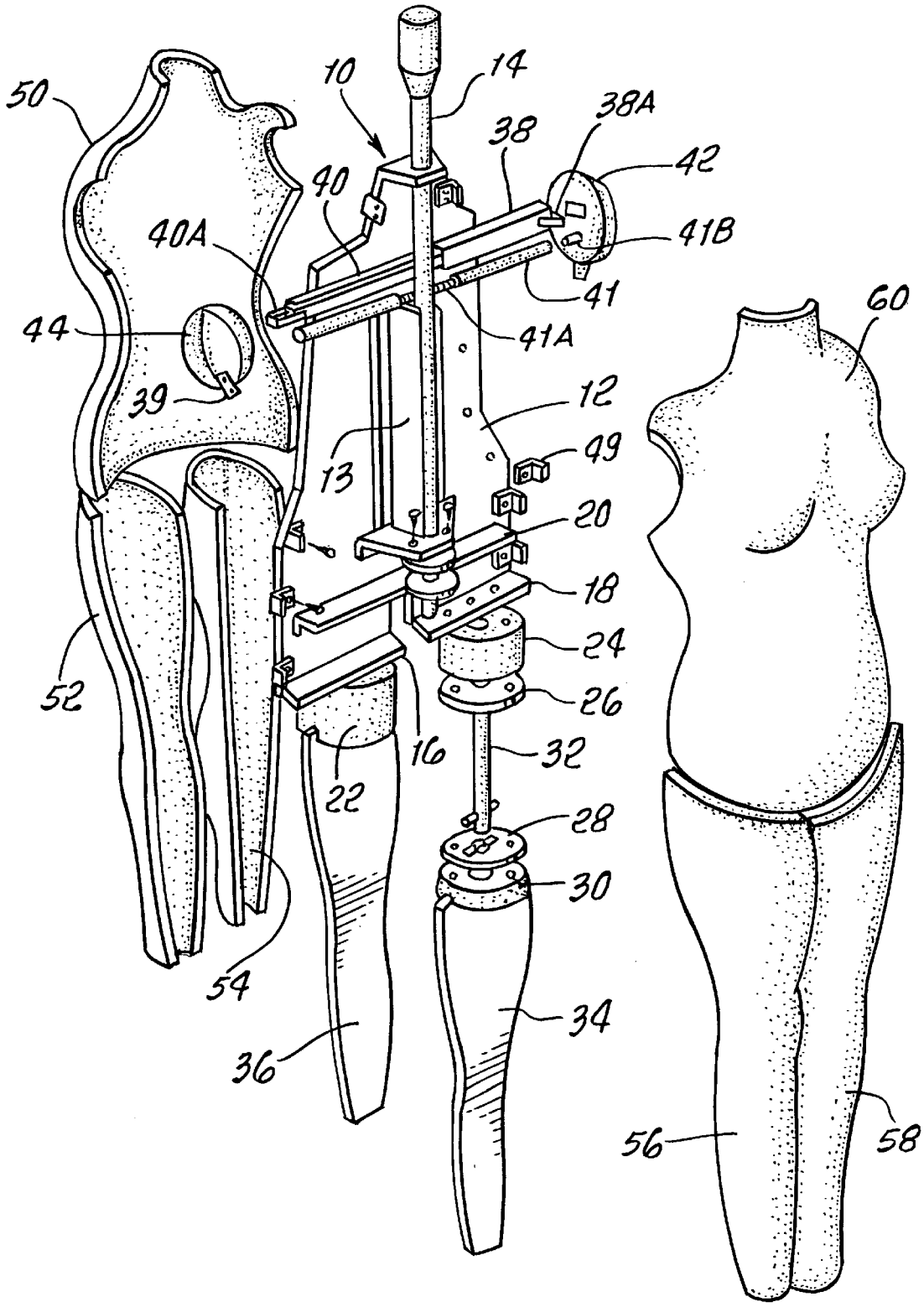
FIG. 9 is a sectional view showing the structure of the safety interlock device of FIG. 5.

FIG. 9 is a sectional view showing the structure of the safety interlock device 94 and its relationship with the brake lever 92 and the rod 73 of gas spring or strut 72. The interlock device includes a housing 100 which contains a flat conical dish 102 and a ball such as a ball bearing 104 which normally remains at the bottom of dish 102. When brake lever 92 is moved upwardly, it causes a pin 106 to be translated upwardly against the force of a spring 108 dislodging ball bearing 104 and moving it upwardly against the rod 73, thus tripping the latch in gas spring or strut 72. When the lever 92 is not actuated, pin 106 remains in its downward position under the urging of spring 108. This keeps gas spring or strut 72 and rod 73 latched in position.

Figure 10:
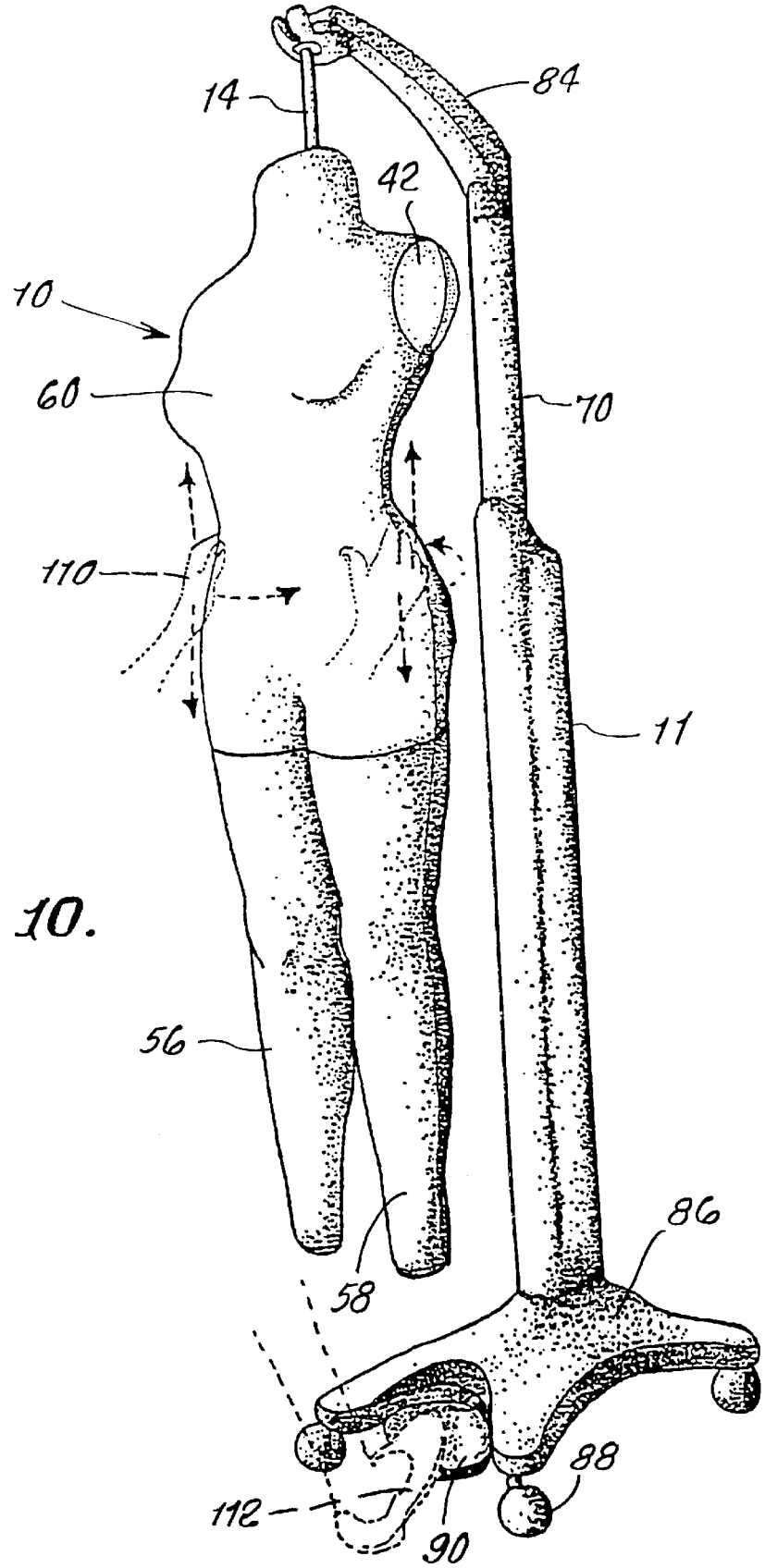
FIG. 10 is a perspective view of the dress form mounted on the stand with operator's hands and foot shown in phantom.

FIG. 10 is a perspective view of the dress form chassis 10 and stand 11 similar to FIG. 1 but including phantom drawings showing hands 110 positioned to move the dress form chassis 10 up or down or around as would normally be done in the course of working on a garment. Similarly, a foot 112 is shown in position to depress pedal 90.

Figure 11:
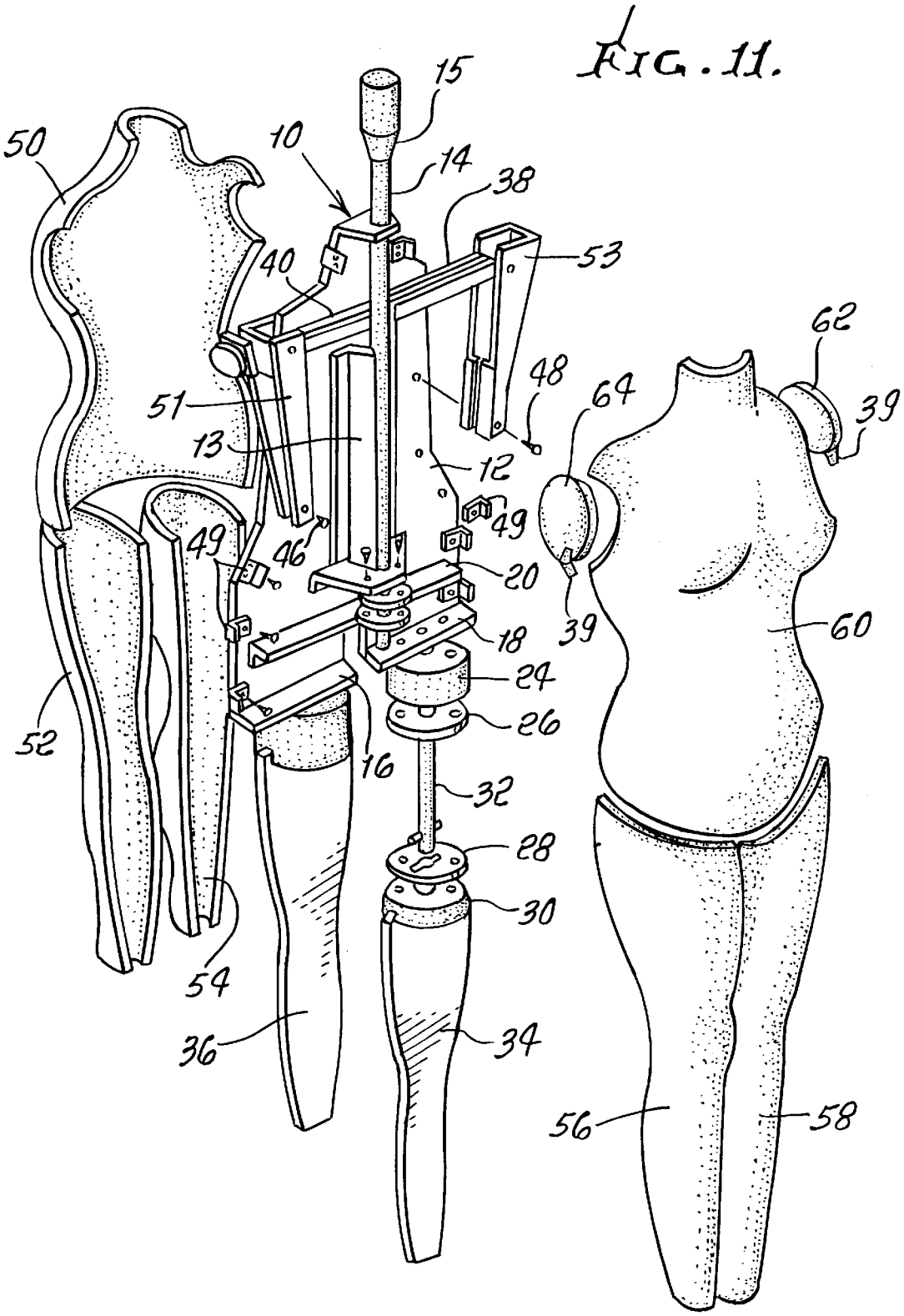
FIG. 11 is an exploded view of an alternate embodiment of the dress form chassis.

FIG. 11 is an exploded view of an alternate embodiment of the dress form chassis. Since only a portion of the chassis is different from that shown on FIGS. 2, 3 and 4, common elements are given the same numerals and only parts not common to the embodiment of FIGS. 3 and 4 have different numerals. The principal difference is in the shoulder structure including the telescoping shoulder members 38 and 40. These members incorporate the ratchet or latch discussed above relative to FIG. 4. They also incorporate an internal spring (not shown) which urges shoulder members 38 and 40 apart. At the ends of shoulder members 38 and 40 are shoulder cap members 62 and 64 which are secured to front torso panel 60 by means of hinges 39 as described above relative to FIG. 4. A pair of shoulder support members 51 and 53 are pivotally secured to the back 12 by pins 46 and 48 and to shoulder members 38 and 40 respectively.

The foregoing embodiments are merely representative of the various ways of carrying out this invention. It is recognized that one of skill in the art might produce other embodiments without departing from the spirit and substance of this invention as set forth above. Therefore, the true scope of this invention is to be judged only by the scope of allowed claims in any resulting patent application including the added protection afforded to the inventors under the Doctrine of Equivalents.

What is claimed is:

1. A dress or clothing form for holding and supporting garments comprising:

a sheet metal frame including reinforcing means;

a support rod carried on said sheet metal frame and said support means;

a pair of leg supports attached to said sheet metal frame;

a plurality of molded plastic body panels including front and back torso panels attached to said sheet metal frame and front and back leg panels attached to said leg supports;

a pair of shoulder panels attached to one of said front and back torso panels; and telescoping shoulder mechanism connected to said shoulder panels for enabling said shoulder panels to be moved inwardly and outwardly to aid in removing and replacing garments on said dress form, said shoulder mechanism includes a telescoping support member for enabling said shoulder pads to be pushed in to help remove said garments and to move outwardly to support garments on said dress form, said shoulder mechanism further comprises resilient means urging said shoulder pads outwardly and a latch holding said shoulder pads in a desired position.

2. A dress or clothing form for holding and supporting garments comprising:

a sheet metal frame including reinforcing means;

a support rod carried on said sheet metal frame and said support means;

a pair of leg supports attached to said sheet metal frame;

a plurality of molded plastic body panels including front and back torso panels attached to said sheet metal frame and front and back leg panels attached to said leg supports;

a pair of shoulder panels attached to one of said front and back torso panels; and telescoping shoulder mechanism connected to said shoulder panels for enabling said shoulder panels to be moved inwardly and outwardly to aid in removing and replacing garments on said dress form, a tapered larger diameter portion at the top end of said support rod, a stand including a support arm having a socket to receive said tapered larger diameter portion, a tubular telescoping support shaft carrying said support arm, means in said shaft enabling said dress form to be raised and lowered, and a pedestal carrying said support shaft, said pedestal including a pedal, and latch means attached to said pedal for preventing said support shaft from telescoping during moving of said dress form.

3. A dress or clothing form as claimed in claim 2 wherein said support shaft includes first and second telescoping members, a rack is operatively connected to one of said telescoping members, a rack is carried on the other of said telescoping members, spring means is operatively connected to one of said racks, and a pinion is secured to said spring means, said pinion being in mesh with both said racks.

4. A dress or clothing form as claimed in claim 2 wherein said spring means is a gas spring and said latch means includes gravity responsive means for releasing said gas spring, a pedestal supporting said support shaft, and means responsive to actuating said pedal for moving said gravity responsive means.

5. A dress or clothing form for holding garments comprising;

a frame including reinforcing means;

a support rod carried on said frame and said reinforcing means;

a pair of leg supports attached to said frame;

a plurality of molded plastic body panels attached to said frame and leg panels attached to said leg supports;

a pair of shoulder panels attached to one of said body panels;

a shoulder mechanism connected to said shoulder panels for enabling said shoulder panels to be moved inwardly and outwardly to aid in removing and placing garments on said dress form, said shoulder mechanism includes a telescoping support member for enabling said shoulder pads to be pushed in to help remove said garments and to move outwardly to support garments on said dress form, and said shoulder mechanism further comprises resilient means urging said shoulder pads outwardly and a latch holding said shoulder pads in a desired position.

6. A dress or clothing form for holding garments comprising;

a frame including reinforcing means;

a support rod carried on said frame and said reinforcing means;

a pair of leg supports attached to said frame;

a plurality of molded plastic body panels attached to said frame and leg panels attached to said leg supports;

a pair of shoulder panels attached to one of said body panels;

a shoulder mechanism connected to said shoulder panels for enabling said shoulder panels to be moved inwardly and outwardly to aid in removing and placing garments on said dress form; and includes first and second telescoping members, a rod is carried in one of said telescoping members and a rack is carried on said rod, a rack is carried on the other of said telescoping members, a gas spring is connected to said rod, and a pinion is secured to said gas spring, said pinion being in mesh with both said racks.

7. A dress or clothing form as claimed in claim 6 further comprising a tapered larger diameter portion at the top end of said support rod, a stand including a support arm having a socket to receive said tapered larger diameter portion, a tubular telescoping support shaft carrying said support arm, means in said shaft enabling said dress form to be raised and lowered, and a pedestal carrying said support shaft, said pedestal including a pedal, and latch means attached to said pedal for preventing said support shaft from telescoping during moving of said dress form.

8. A dress or clothing form as claimed in claim 7 wherein said latch means includes gravity responsive means in contact with said rod for releasing said gas spring, a pedestal supporting said support shaft, and means responsive to actuating said pedal for moving said gravity responsive means.

* * * * *

UNITED STATES PATENT AND TRADEMARK OFFICE

CERTIFICATE OF CORRECTION

PATENT NO. : 6,196,429 B1
DATED : March 6, 2001
INVENTOR(S) : Richard S. Cavdek, Darren Saravis, John Duval, David Potter, Brian Heidsek It is certified that error appears in the above-identified patent and that said Letters Patent is hereby corrected as shown below:

Title page, item [73],
Change the name of the Assignee
FROM: Cyberform Corp. TO: CyberDressForms Inc.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*